United States Patent [19]

Bentel et al.

[11] Patent Number: 5,045,796

[45] Date of Patent: Sep. 3, 1991

[54] APPARATUS FOR RECOGNIZING MISSING OR POOR FIRINGS IN OTTO ENGINES

[75] Inventors: Ulrich Bentel, Wiernsheim-Iptingen; Adolf Dreyer, Hemmingen, both of Fed. Rep. of Germany

[73] Assignee: Robert Bosch GmbH, Stuttgart, Fed. Rep. of Germany

[21] Appl. No.: 547,056

[22] Filed: Jun. 29, 1990

[30] Foreign Application Priority Data

Jul. 20, 1989 [DE] Fed. Rep. of Germany ..... 3924130

[51] Int. Cl.[5] ..... F02P 17/00

[52] U.S. Cl. ..... 324/399; 324/388

[58] Field of Search ..... 324/388, 399, 391; 361/253

[56] References Cited

U.S. PATENT DOCUMENTS

| | | | |
|---|---|---|---|
| 2,335,780 | 11/1943 | McCoy | 324/399 |
| 4,401,948 | 8/1983 | Miura et al. | 324/388 |
| 4,637,247 | 1/1987 | Dreyer et al. | 73/35 |
| 4,742,306 | 5/1988 | Everett et al. | 324/388 |
| 4,918,389 | 4/1990 | Schleupen et al. | 324/399 |

*Primary Examiner*—Kenneth A. Wieder
*Assistant Examiner*—Maura K. Regan
*Attorney, Agent, or Firm*—Frishauf, Holtz, Goodman & Woodward

[57] ABSTRACT

A circuit for recognizing missing or poor firings in Otto (gasoline) engines with multi-circuit ignition systems features a voltage tap on the primary side of each ignition coil (10, 11), leading to a respective controllable transistor (16, 19). A common junction point (21) for the respective transistors provides signals, representative of the control states of the transistors, for evaluation (32). These signals correspond to the respective spark burning voltages. The cylinders fire sequentially, so the voltage patterns of the respective cylinders appear sequentially at the common junction point, and it is possible, even in multi-circuit ignition systems, to monitor the individual ignition circuits in a simple manner, and to interrupt fuel supply to any less-than-optimally firing cylinder, thereby preventing unburnt hydrocarbon overload on the catalytic converter and on the environment. Preferably, the evaluation circuit includes an A/D converter (33) and an INTEL 8051 microprocessor (34).

27 Claims, 2 Drawing Sheets

APPARATUS FOR RECOGNIZING MISSING OR POOR FIRINGS IN OTTO ENGINES

Cross-reference to related patents and application, assigned to the assignee of the present invention, the disclosures of which are incorporated by reference:

U.S. Pat. No. 4,886,037, SCHLEUPEN, issued Dec. 12, 1989, IGNITION SYSTEM FOR AN INTERNAL COMBUSTION ENGINE.

U.S. Pat. No. 4,918,389, SCHLEUPEN et al, issued Apr. 17, 1990, DETECTING MISFIRING IN SPARK IGNITION ENGINES, U.S. Ser. No. 453,403, DENZ & HERDEN, filed Dec. 19, 1989 now U.S. Pat. No. 4,995,365.

FIELD OF THE INVENTION

The present invention relates generally to misfire detection in internal combustion engines and, more particularly, to a circuit for recognizing missing or poor firings in Otto (gasoline) engines with multi-circuit ignition systems.

BACKGROUND

Missing or incomplete firings in Otto engines lead to release of unburned or incompletely burned mixtures into the atmosphere or at least into any catalytic converter present. In addition to the impact on the environment, this leads to damage to the expensive and, in this respect, sensitive catalytic converter. Particularly in the case of Otto engines with many cylinders, e.g. six- to twelve-cylinder engines, the driver scarcely notices the loss of a single cylinder and, even in the case of misses or incomplete combustion in multiple cylinders, detects only a dropoff in power, which could be due to other causes. Thus, there is the danger that, in the event of such a defect in a many-cylindered Otto engine, the engine will continue to be driven, which leads to certain destruction of the catalytic converter.

THE INVENTION

The apparatus of the present invention, with its respective transistor associated with each cylinder and connected to the common junction point, has the advantage that even Otto engines with multi-circuit ignition systems can be provided with a relatively simple means for recognizing missing or poor combustions and indicating them or altering control signals accordingly. The required investment, for an Otto engine with very many cylinders, is increased only slightly beyond that required for an Otto engine with a smaller number of cylinders.

Briefly, the feeding together of all the spark burning signals to a single common junction point reduces the number of signal processing channels to one. There arises then, and only then, a spark burning signal when an ignition has occurred in the respective cylinder. The feeding together of the various spark burning signals to a single common junction point is possible, despite overlapping dwell angles, even with many ignition circuits in the ignition system. This combined spark burning signal can therefore, without further investment, be further processed in a single analog/digital channel or converter. The level of this signal, at the summation point, can be analyzed with respect to its amplitude and duration.

The invention includes several additional refinements and improvements of the basic circuit.

The fact that the transistors are connected via resistors to the common junction point, and that this point is connected via a further resistor to ground, defines a voltage divider, whose tap is always at the same position. This leads to a relatively simple way of feeding together the individual spark burning signals.

Providing a capacitor, connected between the junction point and ground, in parallel with the further resistor, permits suppression of initial surges during the ignition phase, so that more easily evaluated signals are detected.

A particularly simple circuit for detection of the spark burning voltage is possible by using PNP transistors, with their emitters connected to the respective ignition coils, their bases connected to the positive voltage supply pole, and their collectors connected to the single common junction point.

A preferred evaluation circuit, connected to the junction point, compares the voltage trace at this junction point with a voltage trace corresponding to good combustion. This evaluation circuit permits, in the event of a predetermined deviation, activation of a control device and/or a device for shutting off fuel supply to a cylinder exhibiting missing or poor combustion events. In the simplest case, the control device takes the form of a control or malfunction indicator lamp, which alerts the operator of the vehicle to the faulty ignition. However, preferably, the shutoff device activates closure of the respective injection valve, so that no further fuel can flow, thus preventing unburned mixture from reaching the catalytic converter.

For detection of the spark burning signals associated with the respective cylinders, the evaluation circuit preferably includes a sampling circuit, at the summation point, operating synchronously with the ignition processes. This evaluation circuit preferably comprises a microprocessor with an upstream A/D (analog-to-digital) converter, and can, if desired, be integrated into the ignition and fuel injection computer.

Interposition of an integrator, which integrates the spark burning voltage over the combustion period, permits processing of a correction factor for the battery voltage component to obtain a signal representing the combustion energy. The integrator's function can also be performed by appropriate programming of the microprocessor.

The further resistor connected to ground can also be spatially arranged with respect to the evaluation circuit in such a way that its value can be subsequently varied if, for example, a different voltage level is necessary for a different evaluation device, or if the vehicle is designed for selective deactivation of certain cylinders and multiple ignition end stage modules are connected in parallel according to the principle of modular construction.

THE DRAWINGS

FIG. 1 is a diagram of a first embodiment of the circuit of the present invention; and FIG. 2 is a diagram of a second embodiment and of an evaluation circuit connected thereto.

DETAILED DESCRIPTION

Figure 1:
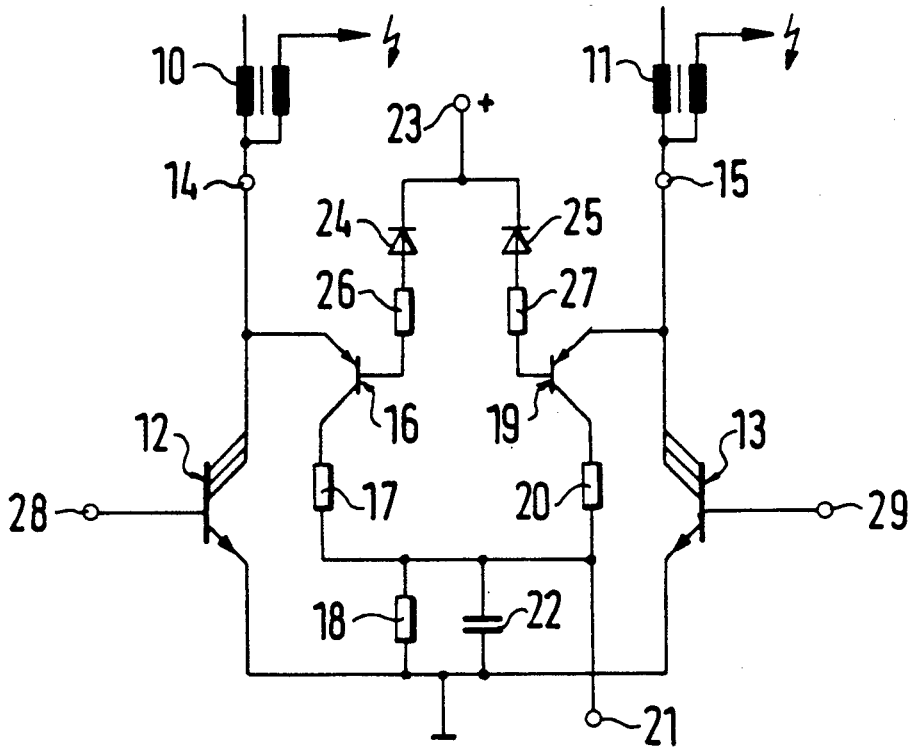

The example illustrated in FIG. 1 shows two ignition circuits of a multi-circuit ignition system. Each of these circuits includes a respective ignition coil 10, 11 whose primary winding is connected in conventional fashion to a respective power transistor 12, 13 which serves as the breaker switch. Each ignition coil 10, 11 is connected at a respective terminal 14, 15 to the collector of the respective power transistor 12, 13, whose emitter is connected to ground. The circuit thus far described is a conventional multi-circuit transistorized ignition system, in which further ignition coils and power transistors can be connected in parallel.

Parallel to the switching path of power transistor 12, there is provided the emitter-collector path of a PNP transistor 15, connected to a voltage divider formed by series-connected resistors 17, 18. Similarly, parallel to the switching path of power transistor 13, there is provided the emitter-collector path of another PNP transistor 19, connected to a voltage divider formed by the series connection of resistor 18 and a resistor 20. The common tap of both voltage dividers, that is, the ground-remote end of resistor 18, defines a summation point which is connected to a common summation or junction point 21. A capacitor 22 is connected in parallel to resistor 18 for suppression of voltage fluctuations caused by initial surges during the ignition phase.

A voltage supply terminal 23 is connected to the positive pole of a supply voltage source (not shown). The base of transistor 16 is connected to terminal 23 via the series connection of a protective diode 24 and a resistor 26. The base of transistor 19 is connected to terminal 23 via the series connection of a protective diode 25 and a resistor 27. Protective diodes 24, 25 serve as base-protection diodes for the respective transistors 16, 19.

The base of each of power transistors 12, 13 is connected via a respective control terminal 28, 29 in conventional fashion to a conventional electronic ignition system (not shown).

To obtain signals at summation terminal 21 for monitoring purposes during the ignition process, the primary-side spark burning voltage at the respective ignition coil 10, 11 is sampled via the respective transistor 16, 19. Transistors 16, 19 provide a collector current to the summation point 21 only when the voltage at terminals 14, 15 exceeds the supply voltage, that is, the voltage value at terminal 23. This is the case during the ignition and burning process. The collector currents of transistors 16, 19 thus define at the tap of voltage divider 17, and voltage divider 20, 18, that is, at summation terminal 21, a specific level which corresponds to the ignition- and burning-voltage. Due to the sequential ignition order of the two ignition circuits or of further ignition circuits, all the signals can be added together at summation terminal 21, yet can still be subsequently associated with the respective cylinders. This is accomplished in an evaluation circuit 32, as described below with reference to FIG. 2.

Figure 2:
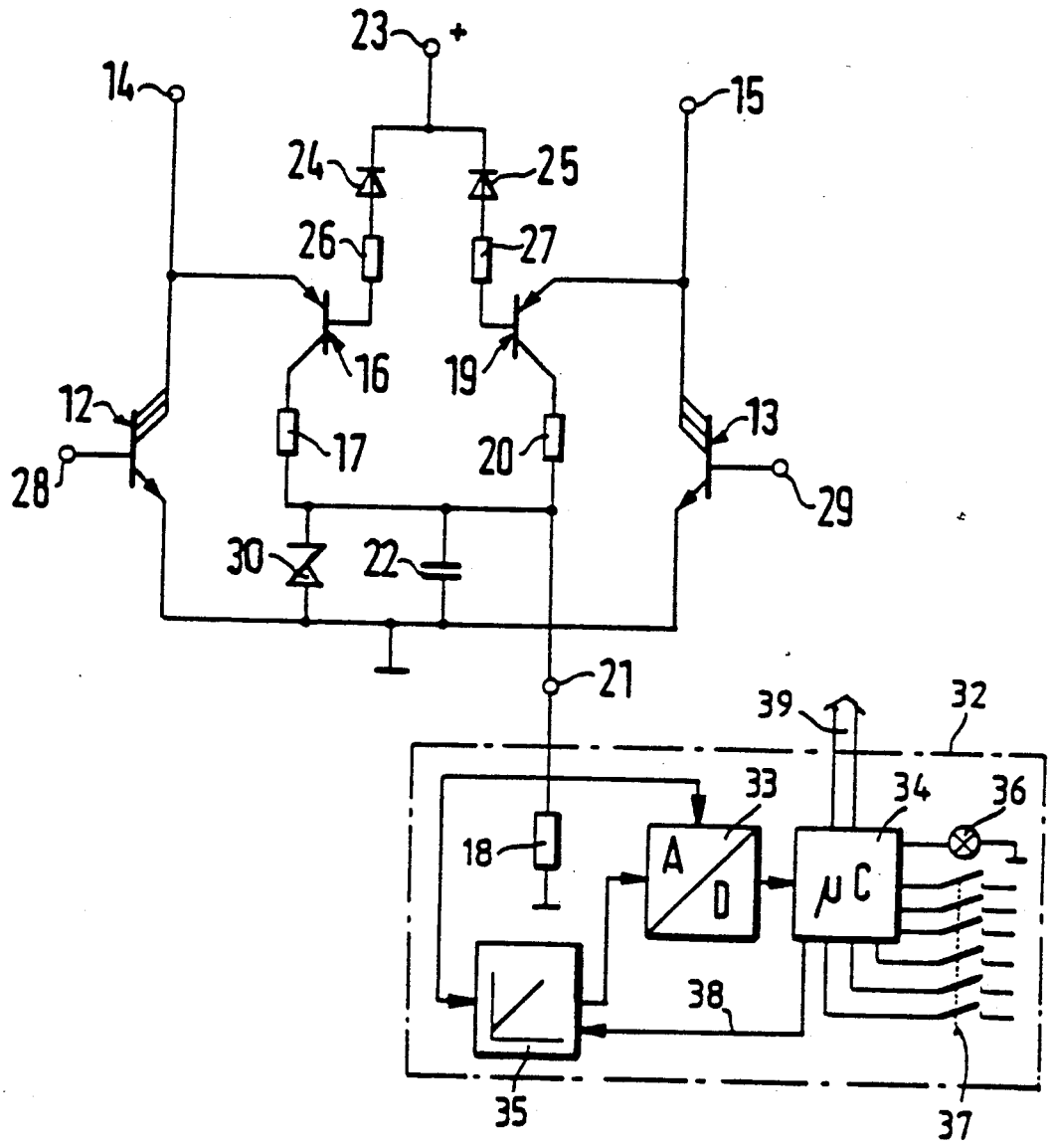

The second embodiment shown in FIG. 2 corresponds substantially to the first embodiment. Identical or identically operating elements have been designated with the same reference numerals and are not described again. However, for protection of transistors 16, 19 against impermissible inverse voltages, a Zener diode 30 has been provided in parallel to capacitor 22. Further the resistor 18, between summation terminal 21 and ground, is connected in the same manner, but is now located in the evaluation circuit 32, which is connected downstream of summation terminal 21.

In evaluation circuit 32, summation terminal 21 is connected to the input of an analog-to-digital (A/D) converter 33, whose output is, in turn, connected to an input of a microprocessor 34. A suitable microprocessor is INTEL 8051. Further, terminal 21 is also connected to the input of an integrator 35, whose output is connected to another input of A/D converter 33. Microprocessor 34 has a plurality of control outputs. The control outputs of microprocessor 34 direct a control lamp 36 and six control switches 37, which serve to interrupt the flow of control signals to respective fuel injection valves (not shown) associated with the six cylinders of the Otto engine, and thus to selectively interrupt the supply of fuel to cylinder(s). Obviously, the number of control switches is given only as an example, since, in principle, any arbitrary number of injection valves of a multi-cylinder combustion engine can be controlled.

An output signal line 38 from microprocessor 34 permits supervision, by it, of integrator 35. Microprocessor 34 is also connected, in conventional fashion, via a data bus 39 to further components, component groups, and any peripheral devices.

Depending upon the respectively occurring combustion processes, there is generated, at summation terminal 21, an ignition- and burning-voltage signal whose contour, level, and duration depend upon the respective ignition and combustion processes in the sequentially firing cylinders. An optimal or ideal combustion event or process has a specific signal course or trace which is pre-recorded in microprocessor 34. Sequential spark burning signals, from the individual ignition processes, appear at summation terminal 21, and these signals are compared with the ideal signal trace. Thus, one can define a tolerance band, independent of the battery voltage, the engine RPM and the engine load. A signal trace within the tolerance band characterizes an adequate ignition process, while an overshoot permits recognition of a missing or poor ignition process. Details of such recognition procedures are set forth in the disclosure of U.S. Pat. No. 4,918,389, to SCHLEUPEN, ZIMMERMAN & LANGNER, assigned to Robert Bosch GmbH, and entitled DETECTING MISFIRING IN SPARK IGNITION ENGINES, and references cited therein. If missing or poor ignition is recognized, microprocessor 34 turns on control or indicator lamp 36 and shuts off fuel feeding to the relevant cylinder. Clearly, this could also occur in stepwise fashion, i.e. overshoot past a first tolerance limit switching on control lamp 37, and only overshoot past a second criterion or further threshold or tolerance level shutting off fuel supply.

Depending upon just how exactly the respective processes are to be specified and recognized, the evaluation of the signal sequences at summation terminal 21 can be carried out more simply. For example, one could monitor only the signal level or the signal length. Such simplified monitoring can make the employment of a microprocessor unnecesssary.

Use of integrator 35 permits integrating the voltage signals at summation point 21 to measure the combustion energy. This can be relied upon as an alternative or supplemental criterion for recognition of a good combustion. For this one needs only to compare the value of the result with a standardized value. Clearly, one could also monitor the integral trace. Integrator 35 can also be a part of microprocessor 34 or the integrator's function can be carried out by appropriate programming of microprocessor 34.

It is also possible to accomplish the monitoring functions of microprocessor 34 in a central computer of the Otto engine, which takes on those monitoring and testing functions. Since the ignition signals are already being furnished by this central computer, consolidating all these functions in a single device reduces the required software and hardware investment.

Various changes and modifications are possible within the scope of the inventive concept.

We claim:

1. Circuit for recognizing missing or poor firings in Otto engines with a plurality of ignition circuits comprising for each ignition circuit, a transistor (16,19) responsive to a respective primary-side spark voltage is provided;

each of said transistors (16, 19) has an output terminal connected to a common junction point (21), from which signals representative of respective control states of said transistors can be detected;

further comprising an evaluation circuit (32) connected to said common junction point (21), comparing an actual voltage pattern picked up at said junction point (21) with a predetermined good-combustion voltage pattern, and generating an error indication if deviation between said voltage patterns exceeds a predetermined maximum deviation.

2. Circuit according to claim 1, wherein respective resistors (17, 20) are provided between each of said transistors (16, 19) and said junction point (21), and a further resistor (18) is provided, connecting said junction point (21) to ground.

3. Circuit according to claim 2, wherein each of said transistors (16,19) is a PNP transistor having an emitter connected to a respective ignition coil (10, 11), a base connected to a positive voltage supply source (23), and a collector connected to said common junction point (21).

4. Circuit according to claim 3, further comprising a resistor (26, 27) and a protective diode (24, 25) connected in series between each transistor base and said positive voltage supply source (23).

5. Circuit according to claim 2, further comprising a capacitor (22) connected in parallel with said further resistor (18).

6. Circuit according to claim 5, wherein each of said transistors (16,19) is a PNP transistor having an emitter connected to a respective ignition coil (10, 11), a base connected to a positive voltage supply source (23), and a collector connected to said common junction point (21).

7. Circuit according to claim 6, further comprising a resistor (26, 27) and a protective diode (24, 25) connected in series between each transistor base and said positive voltage supply source (23).

8. Circuit according to claim 1, wherein each of each transistors (16,19) is a PNP transistor having an emitter connected to a respective ignition coil (10, 11), a base connected to a positive voltage supply source (23), and a collector connected to said junction point (21).

9. Circuit according to claim 8, further comprising a resistor (26, 27) and a protective diode (24, 25) connected in series between each transistor base and said positive voltage supply source (23).

10. Circuit according to claim 8, further comprising a protective element (30) placed in the collector-emitter current path of each transistor and protecting said transistor from voltage inversions.

11. Circuit according to claim 10, further comprising an evaluation circuit (32) connected to said common junction point (21), comparing an actual voltage pattern picked up at said junction point (21) with a predetermined good-combustion voltage pattern, and generating an error indication if deviation between said voltage patterns exceeds a predetermined maximum deviation, and at least one of a control device (36) and a fuel feed shutoff means (37), connected to an output of said evaluation circuit, responsive to said error indication to shut off feeding of fuel to each cylinder of said Otto engine giving rise to an error indication.

12. Apparatus according to claim 11, wherein said control device (36) comprises a control lamp.

13. Apparatus according to claim 11, wherein said fuel feed shutoff means (37) comprises means for blocking a fuel injection signal for an associated fuel injection valve.

14. Circuit according to claim 8, further comprising an evaluation circuit (32) connected to said common junction point (21), comparing an actual voltage pattern picked up at said junction point (21) with a predetermined good-combustion voltage pattern, and generating an error indication if deviation between said voltage patterns exceeds a predetermined maximum deviation, and at least one of a control device (36) and a fuel feed shutoff means (37), connected to an output of said evaluation circuit, responsive to said error indication to shut off feeding of fuel to each cylinder of said Otto engine giving rise to an error indication.

15. Apparatus according to claim 14, wherein said control device (36) comprises a control lamp.

16. Apparatus according to claim 14, wherein said fuel feed shutoff means (37) comprises means for blocking a fuel injection signal for an associated fuel injection valve.

17. Circuit for recognizing missing or poor firings in Otto engines with a plurality of ignition circuits comprising for each ignition circuit, a transistor (16,19) responsive to a respective primary-side spark voltage is provided;

each of said transistors (16, 19) has an output terminal connected to a common junction point (21), from which signals representatives of respective control states of said transistors can be detected; and further comprising an evaluation circuit (32) connected to said common junction point (21), comparing an actual voltage pattern picked up at said junction point (21) with a predetermined good-combustion voltage pattern, and generating an error indication if deviation between said voltage patterns exceeds a predetermined maximum deviation, and at least one of a control device (36) and a fuel feed shutoff means (37), connected to an output of said evaluation circuit, responsive to said error indication to shut off feeding of fuel to each cylinder of said Otto engine giving rise to an error indication.

18. Apparatus according to claim 17, wherein said fuel feed shutoff means (37) comprises means for blocking a fuel injection signal for an associated fuel injection valve.

19. Apparatus according to claim 18, wherein said evaluation circuit (32) samples voltage at said common junction point (21) in a manner synchronized with said ignition processes.

20. Apparatus according to claim 18, wherein said evaluation circuit comprises an A/D converter and a microprocessor connected to an output of said A/D converter.

21. Apparatus according to claim 17, wherein said control device (36) comprises a control lamp.

22. Apparatus according to claim 21, wherein said evaluation circuit (32) samples voltage at said common junction point (21) in a manner synchronized with said ignition processes.

23. Apparatus according to claim 21, wherein said evaluation circuit comprises an A/D converter and a microprocessor connected to an output of said A/D converter.

24. Apparatus according to claim 17, wherein said evaluation circuit (32) samples voltage at said common junction point (21) in a manner synchronized with said ignition processes.

25. Apparatus according to claim 17, wherein said evaluation circuit comprises an A/D converter and a microprocessor connected to an output of said A/D converter.

26. Apparatus according to claim 17, further comprising an integrating element (35) in said evaluation circuit (32) and connected to said common junction point.

27. Apparatus according to claim 17, further comprising a resistor (18) connected between said evaluation circuit (32) and ground.

* * * * *